US010567870B2

(12) United States Patent
Heine et al.

(10) Patent No.: US 10,567,870 B2
(45) Date of Patent: Feb. 18, 2020

(54) SHOTGUN MICROPHONE UNIT

(71) Applicant: Sennheiser electronic GmbH & Co. KG, Wedemark (DE)

(72) Inventors: Lars Heine, Schwülper (DE); Lars Heinrich, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 16/091,238

(22) PCT Filed: Apr. 5, 2017

(86) PCT No.: PCT/EP2017/058054
§ 371 (c)(1),
(2) Date: Oct. 4, 2018

(87) PCT Pub. No.: WO2017/174624
PCT Pub. Date: Oct. 12, 2017

(65) Prior Publication Data

US 2019/0158954 A1 May 23, 2019

(30) Foreign Application Priority Data

Apr. 5, 2016 (DE) ..... 10 2016 106 168

(51) Int. Cl.
*H04R 1/28* (2006.01)
*H04R 1/08* (2006.01)
*H04R 1/34* (2006.01)

(52) U.S. Cl.
CPC ..... *H04R 1/2892* (2013.01); *H04R 1/083* (2013.01); *H04R 1/342* (2013.01)

(58) Field of Classification Search
CPC ..... H04R 1/2892; H04R 1/342; H04R 1/083
See application file for complete search history.

(56) References Cited

U.S. PATENT DOCUMENTS

| | | | | |
|---|---|---|---|---|
| 8,325,960 | B2 * | 12/2012 | Akino | H04R 1/083 381/355 |
| 2007/0195983 | A1 * | 8/2007 | Klemme | H04R 1/08 381/362 |
| 2009/0016558 | A1 * | 1/2009 | Woolf | H04R 1/08 381/368 |
| 2011/0200221 | A1 | 8/2011 | Akino | |
| 2012/0014542 | A1 | 1/2012 | Akino | |
| 2012/0033844 | A1 | 2/2012 | Akino | |
| 2013/0051600 | A1 | 2/2013 | Akino | |
| 2013/0216084 | A1 | 8/2013 | Akino et al. | |
| 2014/0270311 | A1 | 9/2014 | Parker et al. | |
| 2015/0358741 | A1 | 10/2015 | Akino | |

FOREIGN PATENT DOCUMENTS

| | | |
|---|---|---|
| DE | 3220643 | 12/1982 |

OTHER PUBLICATIONS

International Search Report for Application No. PCT/EP2017/058054 dated Jun. 21, 2017.

* cited by examiner

*Primary Examiner* — Brian Ensey
(74) *Attorney, Agent, or Firm* — Haug Partners LLP

(57) ABSTRACT

A shotgun microphone unit which includes a housing, a microphone capsule, a shotgun tube having a longitudinal axis, and a shotgun mounting for mounting the shotgun tube with the microphone capsule within the housing. The shotgun mounting has an axial and a radial mounting, wherein the axial mounting is softer than the radial mounting.

8 Claims, 4 Drawing Sheets

SHOTGUN MICROPHONE UNIT

The present application claims priority from International Patent Application No. PCT/EP2017/058054 filed on Apr. 5, 2017, which claims priority from German Patent Application No. DE 10 2016 106 168.9 filed on Apr. 5, 2016, the disclosures of which are incorporated herein by reference in their entirety.

FIELD OF THE INVENTION

It is noted that citation or identification of any document in this application is not an admission that such document is available as prior art to the present invention.

The present invention concerns a shotgun microphone unit.

Shotgun microphones have long been known and typically comprise a housing, a microphone capsule, a shotgun tube and a structure-borne sound isolation means provided outside the housing.

In the German patent application from which priority is claimed the German Patent and Trade Mark Office searched the following documents: US 2011/0200221 A1, US 2012/0033844 A1, US 2012/0014542 A1, US 2013/0051600 A1, US 2013/0216084 A1 and US 2015/0358741 A1.

SUMMARY OF THE INVENTION

The object of the present invention is to provide a shotgun microphone having improved structure-borne sound isolation, which is of low mass and which can be provided in a small assembly space.

There is provided a shotgun microphone unit comprising a housing, a microphone holder, a shotgun tube and a shotgun tube mounting. The shotgun tube has a first and a second end, a longitudinal axis and a microphone capsule at the second end. The first end of the shotgun tube is in the form of an open end. The shotgun tube mounting has an axial mounting and a radial mounting for mounting the shotgun tube on the housing. The axial mounting is softer than the radial mounting.

As the microphone capsule is fixed at the second end of the shotgun tube the shotgun tube is mounted together with the microphone capsule by means of the shotgun mounting on the housing. Optionally the housing can surround the shotgun tube with the microphone capsule. The shotgun tube mounting can thus be provided within the housing. The shotgun tube mounting thus serves for mounting the shotgun tube per se.

Thus there is provided a shotgun tube microphone unit having a housing, a microphone capsule, a shotgun tube and a structure-borne sound isolation means with a spring element for mounting the shotgun tube with the microphone capsule within the housing. The spring element has a first mounting unit having a first spring and a second mounting unit having a second spring. The first and second mounting units are fixed to the shotgun tube at two different locations of the microphone along the longitudinal axis of the microphone. Accordingly the first mounting unit with the first spring and the second mounting unit with the second spring is provided between the shotgun tube and the microphone holder in order to be able to provide for structure-borne sound isolation.

With the shotgun microphone unit according to the invention it is thus possible to provide for parallel guidance with structure-borne sound isolation. Parallel guidance is effected in particular in parallel relationship in regard to the longitudinal axis of the shotgun tube.

According to the invention each mounting unit is fixed with two points to the shotgun tube and at two points to the microphone holder.

According to an aspect of the invention there is provided a microphone holding means or a shotgun tube mounting which is particularly suitable for avoiding acoustic disturbances which by virtue of handling of the shotgun microphone housing can otherwise be easily recorded by way of the microphone capsule and reproduced as acoustic interference signals.

The mounting of the shotgun tube which has a microphone capsule at the rear end (that is to say opposite to the direction of the useful sound to be recorded) should be as soft as possible so that in consideration of the movement of the outer housing, no interference sound is transmitted to the microphone capsule and is thus output as an electrical signal. That would then be superimposed as an electrical interference signal on the actual electrical useful signal and could no longer be separated therefrom if it is in the same frequency range.

For that purpose the shotgun tube with the microphone capsule disposed at the rear end is isolated from the surrounding housing by structural features as greatly as is possible in the available assembly space, being therefore vibratingly mounted within the housing, so that it can move within certain structurally predetermined distances. That desired effect is achieved by the kind of suspension by means of elements of materials which provide for resilient suspension, but in that respect at the same time exert a marked damping effect on the movements.

Mounting in the axial or radial direction of the shotgun tube with the microphone capsule disposed at the rear end has a very different effect on the transmission of interference signals from the housing to the electrical signal: while the movement in the axial direction deflects the diaphragm of the microphone capsule in the same way as a (useful) sound wave which is entering through the shotgun tube and thus causes a markedly perceptible electrical interference signal (if the frequencies of the mechanical interference phenomena are in the range of audible sound), movements which are transmitted perpendicularly thereto (radially relative to the shotgun tube) and which pass through the center of the diaphragm of the microphone capsule have theoretically no effect whatsoever. In practice those conditions are admittedly not achieved by virtue of the inevitable tolerances in the structure; the effects of the radial interference influences are however also markedly less in practice.

For that reason in the present invention the mounting of the shotgun tube with the microphone capsule is substantially softer in the axial direction than in the radial direction. It will be appreciated that the available assembly space is put to optimum use in both directions in order to achieve damping which is optimum under the given conditions, in both directions; effective decoupling isolation may however turn out to be weaker in the radial direction of movement than in the axial direction, for the reasons described.

Previous constructions are typically not limited to such a small assembly space. In general they use suspension means for the shotgun tubes, which are disposed outwardly (that is to say outside the housing of the microphone unit), in order to damp them sufficiently in relation to the sound of movement. That mostly results in quite bulky structures (so-called "spiders") which consist of a plurality of long elastic (rubber) bands and into which the complete microphone is suspendingly fitted.

That awareness gives rise to the following demands which are implemented in the construction set forth by way of example: the mounting of the shotgun tube with the rearwardly disposed microphone capsule is of different softness in the axial and radial directions, more specifically in such a way that it is markedly softer in the axial direction (and thus in the perpendicular direction to the surface of the microphone diaphragm) than in the radial direction. The distance that the shotgun tube can vibrate without hitting is markedly greater in that direction and damping is thereby effected to a greater degree than in the radial direction.

The construction can be implemented by the doubled configuration and by the symmetry (up/down and left/right) of the "springs", in such a way that even in the event of very great deflections the shotgun tube always faces in the same direction and thus the event to be recorded is not diverted out of the main acoustic lobe of the shotgun microphone. "Wobbling" out of the actual target direction can thus be excluded. As a slight deviation from the acoustic orientation can already result in a really disturbing sound impression (in particular if that occurs a number of times or indeed periodically), this property is of particularly high significance for a directional microphone.

The shotgun microphone unit according to the invention makes it possible to provide for good structure-borne sound isolation with at the same time a reduction in the assembly space required. The structure-borne sound isolation means using the first and second mounting units is disposed within the housing.

BRIEF DESCRIPTION OF THE DRAWINGS

Advantages and embodiments by way of example of the invention are described in greater detail hereinafter with reference to the drawing.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
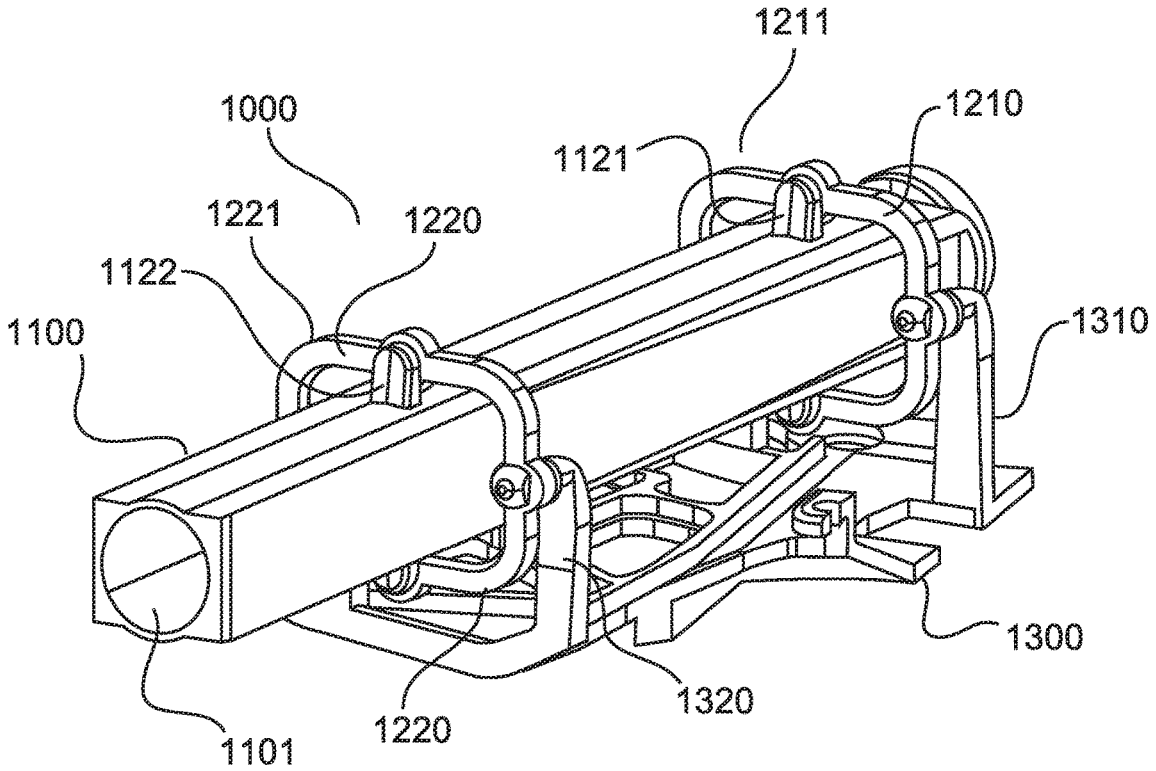
FIG. 1 shows a perspective view of a shotgun microphone unit according to the invention.
Figure 2:
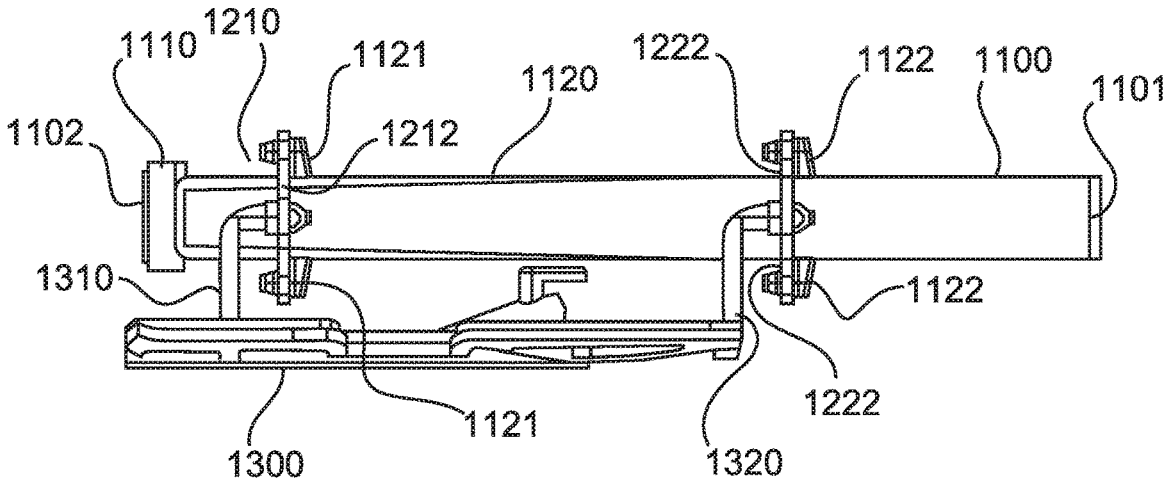
FIG. 2 shows a side view of a shotgun microphone unit without housing according to the invention.

FIG. 1 shows a perspective view of the shotgun microphone unit without housing. FIG. 2 shows a side view of the shotgun microphone unit without housing.

The shotgun microphone unit 1000 has a microphone holder 1300 having first and second arms 1310, 1320. The first and second arms 1310, 1320 optionally extend at a right angle to the microphone holder 1300. The first and second arms 1310, 1320 each have a first free end.

Figure 5:
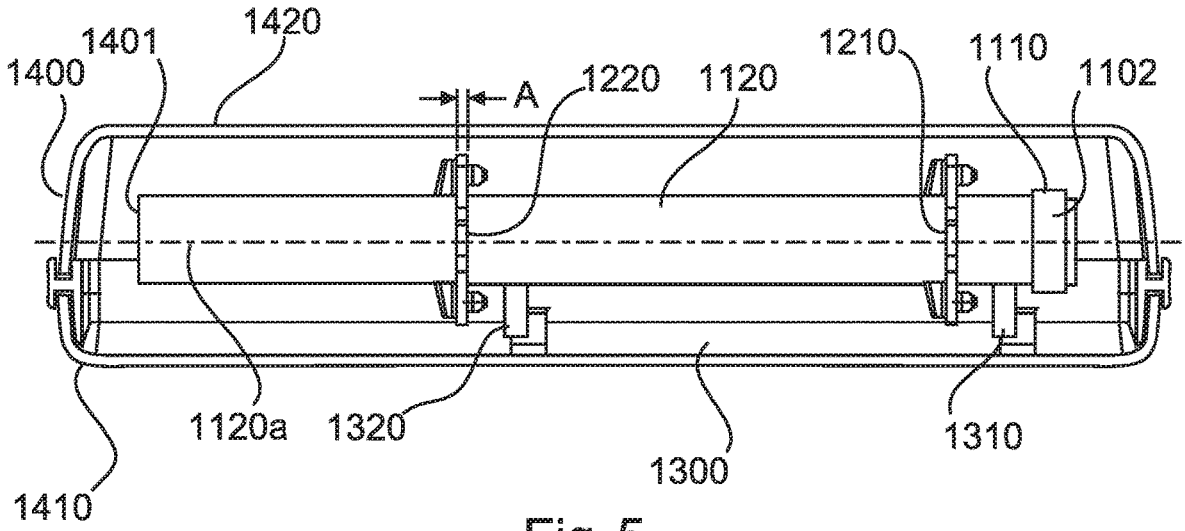
FIG. 5 shows a diagrammatic sectional view of a shotgun microphone unit according to the invention.

The shotgun microphone unit 1000 further has a microphone unit 1100 having a microphone capsule 1110 and a shotgun tube 1120 which is in the form of an interference tube. The shotgun tube 1120 has a second end 1102 facing away from the direction of the useful sound to be recorded and an oppositely disposed first end 1101 facing in the direction of the useful sound to be recorded. The microphone capsule 1110 is fixed to the shotgun tube 1120 at the second end 1102 thereof. The shotgun tube 1120 extends along a longitudinal axis 1120*a* (FIG. 5). First and second fixing units 1121, 1122 are provided on the shotgun tube 1120. In that case the first fixing units 1121 are arranged spaced from the second fixing units 1122 along the longitudinal axis 1120*a*. Provided between the free ends of the arms 1310, 1320 of microphone holder and the first and second fixing units 1121, 1122 of the shotgun tube 1120 are first and second spring elements 1210, 1220 respectively. The first and second spring elements 1210, 1220 are respectively provided at the free ends of the two first arms 1310 and the first fixing units 1121 of the shotgun tube 1120. The spring units 1210, 1220 can be of a two-part configuration so that a first part is coupled to the free ends of the two first arms 1310 and the first fixing units 1121. The two arms 1310 lie outside the shotgun tube 1120. The spring units 1210, 1220 which can be of a two-part configuration can for example each be of a U-shaped configuration, wherein the spring units 1210, 1220 can be coupled at their free ends to the arms 1310, 1320 of the microphone holder.

As can be seen from FIG. 2 the first and second arms 1310, 1320 can be of an L-shaped configuration and so arranged that the free ends for receiving the spring elements 1210, 1220 have a respective portion oriented parallel to the longitudinal axis 1120*a*. In that way the first and second arms 1310, 1320 can be arranged closer to the shotgun tube 1120 without impeding deflection of the spring elements 1210, 1220. That permits the shotgun microphone unit 1000 to involve a smaller assembly space.

Figure 3:
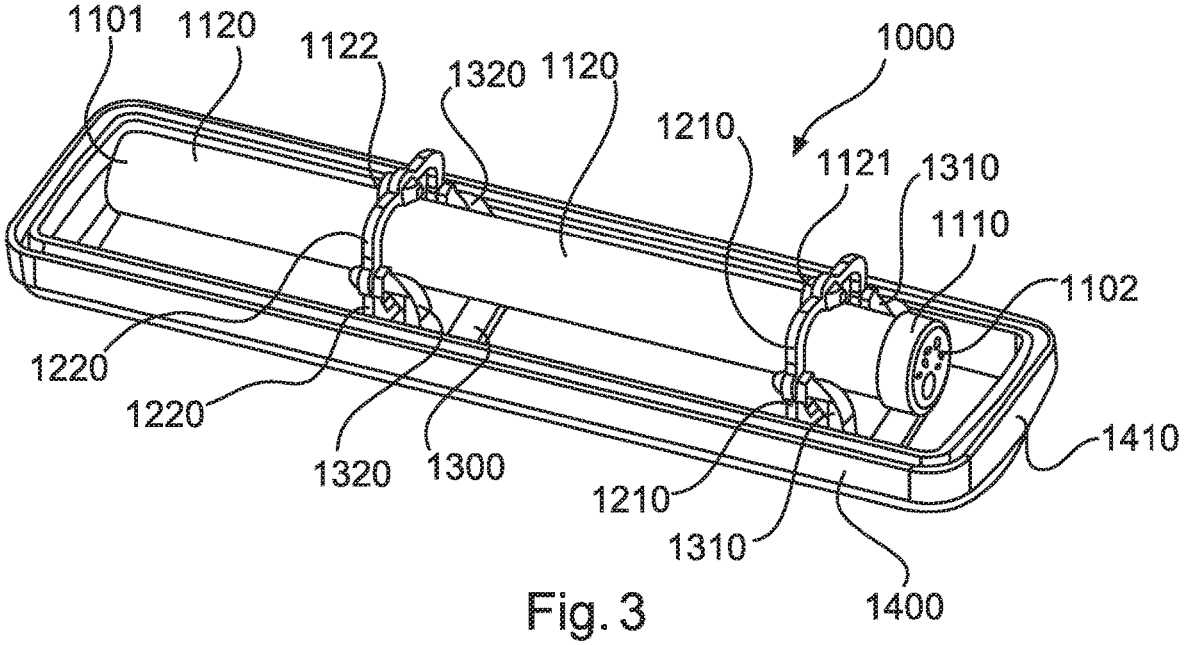
FIGS. 3 and 4 each show a perspective view of a shotgun microphone unit according to the invention.
Figure 4:
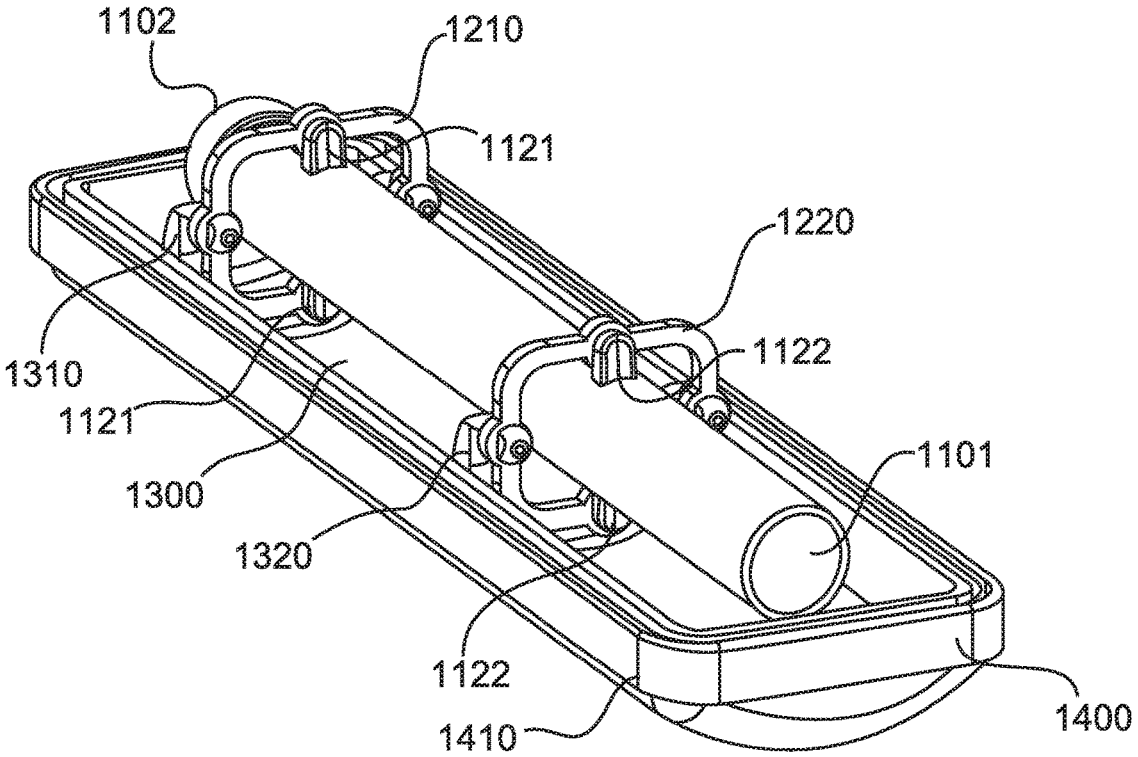

FIGS. 3 and 4 show the shotgun tube 1120, the microphone holder 1300 and the spring elements 1210, 1220 in a lower half 1410 of a housing 1400.

The shotgun tube 1120 has first and second fixing units 1121, 1122 which are respectively coupled to a first and a second spring element 1210, 1220. The first and second spring elements 1210, 1220 are in turn coupled to the first and second arms 1310, 1320. Preferably the shotgun tube 1120 has two first and two second fixing units 1121, 1122 which are respectively fixed at mutually opposite sides of the shotgun tube 1120. Optionally there can be provided two first and two second spring elements 1210, 1220 in order to couple the shotgun tube 1120 to the microphone holder 1300 in such a way that this provides structure-borne sound isolation.

FIG. 5 shows a longitudinal section through the shotgun microphone unit. In addition to the lower half 1410 the housing 1400 has an upper half 1420. The housing 1400 thus encloses the entire microphone unit 1100 with the shotgun tube 1120 and the microphone capsule 1110. In addition the mounting with the two spring elements 1210, 1220 is provided in the interior of the housing 1400 so that the microphone unit 1100 is mounted in structure-borne sound-isolated relationship with respect to the housing 1400.

Figure 6:
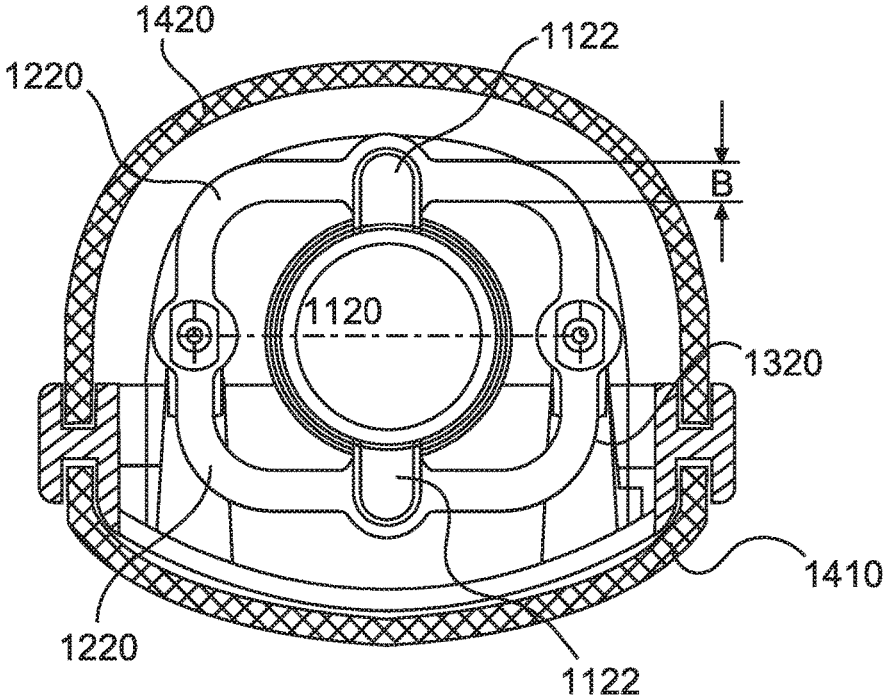
FIG. 6 shows a further sectional view of the shotgun microphone unit according to the invention.

FIG. 6 shows a further cross-section of the shotgun microphone unit from a direction viewing on to the first end 1101.

Figure 7:
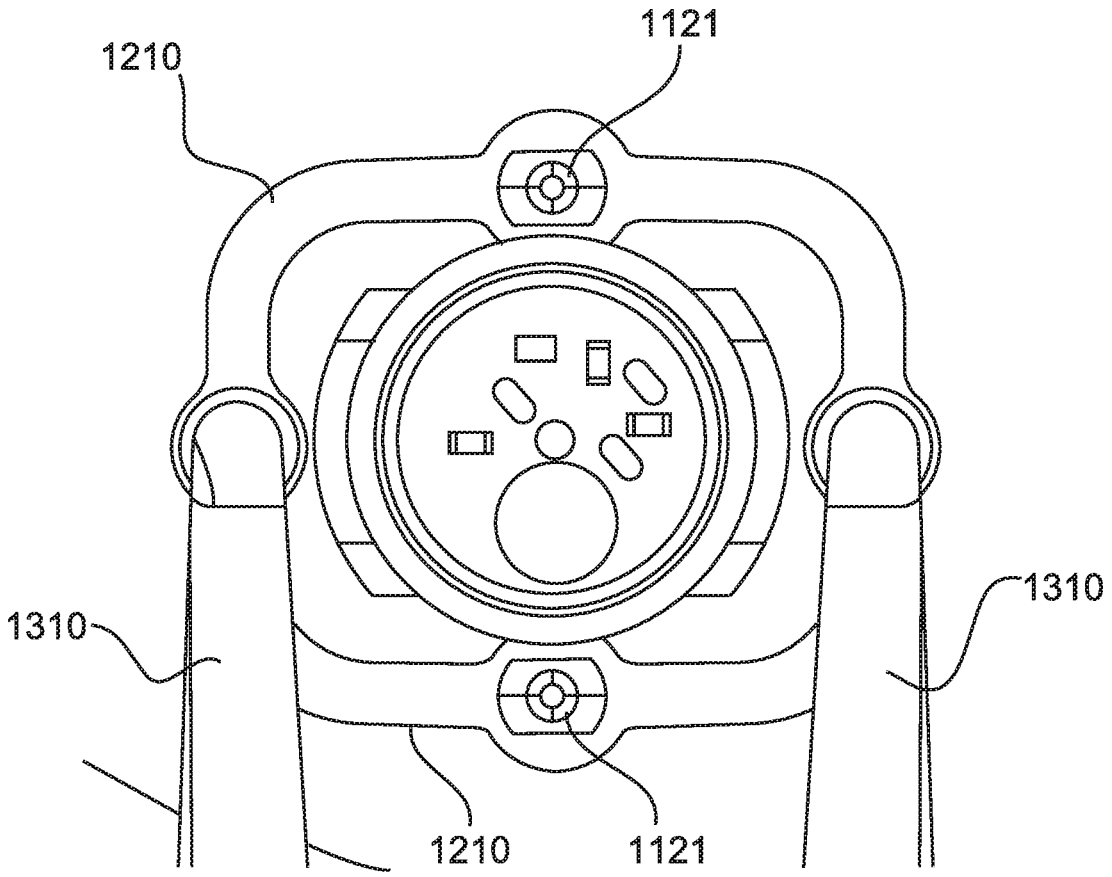
FIG. 7 shows a further diagrammatic sectional view of a portion of the shotgun microphone unit according to the invention.

FIG. 7 shows a diagrammatic cross-section of the shotgun microphone unit from a direction viewing on to the second end 1102.

For mounting the shotgun tube 1120 in or on the microphone holder 1300 in structure-borne sound isolated relationship the microphone holder 1300 has two first and two second arms 1310, 1320 respectively, wherein the two first arms 1310 are arranged spaced from the two second arms 1320 along the longitudinal axis 1120*a*. Preferably the two open ends of the two first arms 1310 are disposed on two mutually opposite sides of the shotgun tube 1120 so that a notional connecting line between the two open ends of the two first arms 1310 perpendicularly intersects the central axis 1120*a* of the shotgun tube. The open ends of the two second arms 1320 are preferably disposed in mutually opposite relationship in the same way at the sides of the shotgun tube 1120. The shotgun tube 1120 has two first and two second fixing units 1121, 1122, wherein the two first fixing units 1121 are arranged spaced from the two second fixing units 1122 along the longitudinal axis 1120*a*. Preferably the two first fixing units 1121 are arranged on two mutually opposite sides of the shotgun tube 1120 so that a notional connecting line between the two first fixing units 1121 perpendicularly intersects the central axis 1120*a* of the shotgun tube. The two first fixing units 1122 are preferably arranged in mutually opposite relationship in the same way at the sides of the shotgun tube 1120. The first and second arms 1310, 1320 and the first and second fixing units 1121, 1122 are respectively coupled by way of first and second spring elements 1210, 1220. In that way the shotgun tube 1120 is mounted in structure-borne sound isolated relationship at two different locations. In that way there can be provided a first mounting involving a first mounting unit 1211 having the first arms 1310 and the first fixing units 1121 and a second mounting involving a second mounting unit 1221 having the second arms 1320 and the second fixing units 1122, wherein they are respectively coupled by means of a first or a second spring element 1210, 1220. Preferably the first mounting unit 1211 is of such a configuration that the notional connecting line between the two open ends of the two first arms 1310 is oriented perpendicularly to the notional connecting line between the two first fixing units 1121 and the second mounting unit 1221 is of a configuration in the same way as the first mounting unit 1211, but arranged displaced with respect to the longitudinal direction 1120*a*.

By virtue of the U-shaped configuration of the spring elements 1210 and 1220, that affords an increase in length of the springs and thus a higher level of flexibility. In addition the cross-section of the springs in the axial direction affords a higher level of flexibility than in the radial direction. The material thickness B (FIG. 6) in the radial direction is greater by the factor >1.5 than the material thickness A (FIG. 5) in the axial direction.

According to the invention there is provided a parallel connection of four individual springs 1210, 1220. The optional four individual springs are in the form of two spring segments and permit parallel guidance so that this gives a high level of positional stability. The high positional stability and the high flexibility in the axial direction is further achieved by the above-described material arrangement.

The housing 1400 is of a sound-permeable configuration and encloses a volume. The housing 1400 can serve as a wind protection, the enclosed volume serving as a calming zone for wind turbulence. At the same time a housing 1400 which is as small as possible is desired for good handlability. In addition the microphone should be insensitive in relation to structure-borne sound. According to the invention therefore provided in the interior of the housing 1400 is the structure-borne sound isolation using the two described mounting unit 1211, 1221 so that the shotgun tube 1120 jointly with the microphone capsule 1110 fixed thereto is mounted in structure-borne sound isolated relationship with respect to the surrounding housing 1400. In that respect, to reduce the assembly space required, use is made of the realization that a directional microphone is less sensitive to vibrations and shocks in the radial direction than in the axial direction. Thus there is provided a mounting arrangement which is firmer in the radial direction than in the axial direction so that less space is required in the radial direction, which would arise out of the additional required oscillation travel when involving a softer mounting. In the axial direction however this arrangement provides the softer mounting which is required because of the higher level of sensitivity of the directional microphone in that direction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A shotgun microphone unit comprising:

a housing;

a microphone holder;

a shotgun tube having a first end and a second end; and a shotgun mounting having an axial mounting and a radial mounting for mounting the shotgun tube to the housing;

wherein the shotgun tube has a longitudinal axis and a microphone capsule at its second end, wherein the first end of the shotgun tube is in the form of an open end;

wherein the axial mounting is softer than the radial mounting;

wherein the shotgun tube has at least two mutually opposite fixing units and the microphone holder has at least two arms;

wherein spring elements are respectively provided between the arms and the fixing units and the spring elements are of a cross-section which is greater in the radial direction than in the axial direction by at least the factor 1.5; and wherein the arms are L-shaped and respectively have a portion oriented parallel to the longitudinal axis for receiving the spring elements.

2. The shotgun microphone unit as set forth in claim 1;

wherein the shotgun tube mounting has a first and a second mounting unit which are adapted for structure-borne sound isolation between the shotgun tube and the microphone holder respectively;

wherein the first and second mounting units are arranged along the longitudinal axis of the shotgun tube; and wherein the at least two mutually opposite fixing units, the at least two arms, and the spring elements form at least one of the mounting units.

3. The shotgun microphone unit as set forth in claim 1;

wherein the at least two arms of the microphone holder are of an L-shaped configuration and respectively have a free end having an angled portion oriented parallel to the longitudinal axis for receiving the spring elements.

4. The shotgun microphone unit as set forth in claim 1; wherein the microphone holder and the shotgun tube are provided within the housing and the housing completely encloses the microphone holder and the shotgun tube.

5. The shotgun microphone unit as set forth in claim 2; wherein the microphone holder has at least two second arms and the second spring elements are respectively coupled to the free ends of the second arms and the second fixing units;

wherein the second fixing units are provided at opposite sides of the shotgun tube; and wherein the free ends of the second arms are provided at opposite sides of the shotgun tube; and wherein the second fixing units, the second spring elements and the second arms form the second mounting unit.

6. The shotgun microphone unit as set forth in claim 1; wherein each spring element comprises two U-shaped spring segments which are substantially arranged in a plane.

7. The shotgun microphone unit as set forth in claim 1; wherein the housing is sound-permeable.

8. The shotgun microphone unit as set forth in claim 1; wherein the spring elements are arranged substantially transversely to the longitudinal axis.

* * * * *